US010006314B2

(12) United States Patent
Lutz et al.

(10) Patent No.: US 10,006,314 B2
(45) Date of Patent: Jun. 26, 2018

(54) DEVICE AND METHOD FOR RECOVERING WASTE HEAT ENERGY AND A UTILITY VEHICLE

(71) Applicant: MAHLE International GmbH, Stuttgart (DE)

(72) Inventors: Rainer Lutz, Steinheim (DE); Giovanna Motisi, Stuttgart (DE); Richard Bruemmer, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 0 days. days.

(21) Appl. No.: 14/549,204

(22) Filed: Nov. 20, 2014

(65) Prior Publication Data

US 2015/0135708 A1 May 21, 2015

(30) Foreign Application Priority Data

Nov. 20, 2013 (DE) ..... 10 2013 223 740

(51) Int. Cl.
*F01K 23/06* (2006.01)
*F01K 3/00* (2006.01)
*F01K 13/02* (2006.01)

(52) U.S. Cl.
CPC ..... *F01K 23/065* (2013.01); *F01K 3/004* (2013.01); *F01K 13/02* (2013.01)

(58) Field of Classification Search
CPC ..... F01K 23/065; F01K 13/02; F01K 3/004; F01K 9/023
USPC ..... 60/646, 657, 665, 667
See application file for complete search history.

(56) References Cited

U.S. PATENT DOCUMENTS 3,287,241 A * 11/1966 Smith ..... C07C 17/02 204/158.1
6,829,894 B2 12/2004 Bloch et al.
7,594,399 B2 * 9/2009 Lehar ..... F01K 25/06 60/649
8,800,285 B2 8/2014 Ernst et al.
(Continued)

FOREIGN PATENT DOCUMENTS

DE 102 28 868 A1 1/2004
DE 10 2009 050 068 A1 4/2011
(Continued)

*Primary Examiner* — Jason T Newton
(74) *Attorney, Agent, or Firm* — Muncy, Geissler, Olds & Lowe, P.C.

(57) ABSTRACT

A device for recovering the waste heat energy having a Clausius-Rankine circuit with a line system conveying a working medium via which at least one vaporizer for vaporizing the working medium, an expansion device for expanding the vaporized working medium to produce mechanical work, a condenser for fluidizing the vaporized and expanded working medium as well as a delivery pump for condensing and conveying the working medium through the line system are fluidically connected to one another. A compensation tank supplies additional working medium volume and is connected to a fluid line and can be fluidically separated from the line system via a valve that is controllable via a control device connected to a sensor for detecting working medium temperature and/or pressure, such that a working medium volume is transferred from the compensation tank into the line system or from the line system into the compensation tank.

11 Claims, 7 Drawing Sheets

(56) References Cited

U.S. PATENT DOCUMENTS

| | | | | |
|---|---|---|---|---|
| 2005/0072182 | A1 | 4/2005 | Taniguchi et al. | |
| 2010/0287920 | A1 | 11/2010 | Duparchy | |
| 2011/0185733 | A1* | 8/2011 | Ramaswamy | F01K 25/08 60/651 |
| 2012/0210713 | A1* | 8/2012 | Ernst | F01N 5/02 60/615 |
| 2013/0327041 | A1* | 12/2013 | Gaertner | F01K 13/02 60/615 |

FOREIGN PATENT DOCUMENTS

| | | | | |
|---|---|---|---|---|
| DE | 10 2010 025 184 | A1 | 12/2011 | |
| DE | 10 2011 117 054 | A1 | 5/2012 | |
| DE | 10 2010 054 733 | A1 | 6/2012 | |
| DE | 10 2010 056 196 | A1 | 6/2012 | |
| DE | 102010054733 | A1 * | 6/2012 | F01K 13/02 |
| DE | 10 2012 000 100 | A1 | 7/2012 | |
| DE | 102012000100 | A1 * | 7/2012 | F01N 5/02 |
| EP | 2 357 324 | A2 | 8/2011 | |
| WO | WO 2011/131482 | A2 | 10/2011 | |

* cited by examiner

DEVICE AND METHOD FOR RECOVERING WASTE HEAT ENERGY AND A UTILITY VEHICLE

This nonprovisional application claims priority under 35 U.S.C. § 119(a) to German Patent Application No. 10 2013 223 740.5, which was filed in Germany on Nov. 20, 2013, and which is herein incorporated by reference.

BACKGROUND OF THE INVENTION

Field of the Invention

The invention relates to a device for recovering waste heat energy, to a utility vehicle, and to a method for recovering waste heat energy.

Description of the Background Art

Devices and methods are known from the prior art, for example, it is known that a Clausius-Rankine circuit can be used to at least partly reclaim the waste heat energy of an internal combustion engine particularly for the purpose of improving fuel efficiency in an internal combustion engine of a motor vehicle, in particular a utility vehicle. A system used for this purpose is frequently also called a WHR (waste heat recovery) system. The key components of a WHR system of this type based on a Clausius-Rankine circuit and having a line system conveying a working medium are: one or more vaporizers in which the working medium can be vaporized; an expansion machine in which the pressurized vaporous working medium is expanded. In this process the working medium performs work, where the exerted output can be used in the motor vehicle through direct mechanical action or indirectly as electricity following conversion by means of a generator. A condenser is additionally provided which returns the vaporous working medium to liquid form downstream following expansion in the expansion machine. In this context, the condenser can either be operated using air as cooling medium or can be integrated into the vehicle cooling circuit and thus use the internal combustion engine coolant as cooling medium. Alternatively, a separate cooling circuit can be used for cooling the condenser. Another key component is a delivery pump for conveying and compressing the working medium within the line system. To ensure the reliable operation of the delivery pump, particularly as protection against cavitation, the working medium must absolutely be supercooled specifically at the delivery pump intake. In addition, sensors, control valves and oftentimes also a compensation tank for storing additional working medium are present. A number of different systems already exist which ensure a required or desired supercooling of the working medium at the delivery pump, specifically in front of a working medium intake opening of the delivery pump.

For instance, a WHR system of this type or the line system thereof can be designed as an open system to realize a Clausius-Rankine circuit. In an open system of this type, the compensation tank is left open to the environment so that the condensation pressure is always equal to ambient pressure. To ensure the required supercooling of the working medium at each operating phase of the motor vehicle in an open system of this type, an inlet temperature, for example of a coolant flowing through the condenser of a cooling system provided for the purpose stated above must be appropriately low, i.e. the inlet temperature must be lower than the condensation temperature minus the desired supercooling. In this situation the working medium exits the condenser with a supercooling solely dependent on coolant temperature. Because, however, the maximum installation space available in the motor vehicle and thus the maximum performance capacity of a cooling system are limited, an open system of this type does not always permit a required supercooling of the working medium, particularly at a working medium intake opening of a delivery pump, to always be reliably ensured at all ambient temperatures. At higher ambient temperatures, there is the danger that the WHR system has to be slowed down or even completely deactivated. However, one advantage of this system is that the shutting down of the motor vehicle and the cooling down of the engine and the powertrain elements thereof does not result in a critical negative pressure in the line system for realizing the Clausius-Rankine circuit. This prevents the risk of contamination of the WHR system through the permeation of air for example at seals, pipe connections, exit shaft of the expansion machine, etc. to the greatest extent possible.

If, on the other hand, a WHR system of this type or the line system thereof for realizing the Clausius-Rankine circuit is designed as a closed system, it can reliably be hermetically sealed against the environment. This allows different condensation pressure levels to be set in the condenser, it being generally recommended to set an operating point on the appropriate vapor pressure curve. This operating point is based on the particular combination of condensation pressure and condensation temperature. No supercooling is initially present at the working medium outlet of the condenser. To achieve a desired supercooling of the working medium in the closed system, particularly at the working medium outlet of the condenser, two options can be considered in principle. On the one hand, the desired or intended supercooling can be achieved by means of a supercooling segment connected downstream from the condenser. However, a supercooling likewise connected downstream from the condenser is also required which in general must be operated with a colder cooling medium than the condenser connected upstream to always reliably ensure supercooling. On the other hand, the desired or intended supercooling can be achieved with a generally available high filling quantity of working medium in the line system, which increases average density and thereby ultimately the pressure within the line system, which allows the achievable supercooling to be increased. A general problem in a hermetically closed system of this type is posed, however, by the relatively high negative pressures, which occur as soon as the Clausius-Rankine circuit is not running. These relatively high negative pressures often reach several 100 mbar of relative negative pressure. In this case it is highly doubtful that the system will remain permanently sealed against the environment. Air penetrating the line system due to leakiness poses a problem, since this would cause a change in system pressure such that the achievable supercooling and the penetrating air could compromise the performance capacity of the WHR system.

For example, the patent document DE 10 2009 050 068 A1 describes an internal combustion engine having a cooling circuit and a Clausius-Rankine circuit for waste heat recovery in which the Clausius-Rankine circuit is connected to the cooling circuit via a heat exchanger device in such a way that the waste heat of the cooling circuit can heat and thus vaporize a working medium circulating in the Clausius-Rankine circuit. The Clausius-Rankine circuit comprises a condenser, a pump, an expansion unit, as well as a compensation tank that is always open to the Clausius-Rankine circuit for compensating fluctuations in the volume and/or pressure of the working medium circulating within the Clausius-Rankine circuit. The compensation tank is characterized by a primary chamber in which a portion of the volume of the circulating working medium is present. The compensation tank additionally features a secondary chamber separated from the primary chamber by a membrane in which compressed air can be supplied. Fluctuations in volume and/or pressure of the working medium circulating in the Clausius-Rankine circuit can be compensated through the pressure conditions prevailing in the secondary chamber. For this purpose the secondary chamber is functionally connected to a pressure control device which actively regulates the working medium pressure prevailing in the compensation tank, thereby allowing in general the efficiency of the Clausius-Rankine circuit and thus the efficiency of the expansion unit in particular to be influenced.

Another patent document DE 2011 117 054 A1 furthermore discloses a device for recovering energy from a waste heat flow of an internal combustion engine in a motor vehicle with a working medium circuit. A Clausius-Rankine circuit process takes place within the working medium circuit, wherein integrated in the working medium circuit is a working medium reservoir characterized by a fill level sensor which allows working medium fill level in the working medium circuit to be ascertained and compared to a prescribed specified fill level. If a critical deviation is detected, an optic, acoustic and/or haptic warning is emitted to the vehicle driver. The working medium reservoir can either be connected to the line system of the working medium circuit via an always open and thus passable dead leg or directly constitute a physical segment of the working medium circuit through which the working medium directly flows.

SUMMARY OF THE INVENTION

It is therefore an object of the present invention to provide a device via which a desired supercooling level, particularly at a condenser outlet, can always be maintained or set as accurately as possible.

In an embodiment, a device is provided for recovering the waste heat energy of an internal combustion engine in a motor vehicle comprising a Clausius-Rankine circuit with a line system conveying a working medium by means of which at least one vaporizer for vaporizing the working medium, an expansion device for expanding the vaporized working medium to produce mechanical work, a condenser for fluidizing the vaporized and expanded working medium as well as a delivery pump for condensing and conveying the working medium through the line system are fluidically connected to one another, wherein on the line system a compensation tank for supplying additional working medium volume is connected to a fluid line or multiple fluid lines, and wherein the compensation tank can be fluidically separated from the line system by means of a valve, the valve being controllable on the basis of detected temperature and/or detected pressure via a control device which is connected at least to a sensor at the condenser outlet for detecting working medium temperature and/or pressure, in such a manner that a working medium volume is transferred from the compensation tank into the line system or from the line system into the compensation tank.

The compensation tank can be a compensation tank which can be fluidically separated from the line system and which can be temporarily connected fluidically to the line system such that within the line system an at least local supercooling of the working medium can be adjusted as a function of a working medium volume transferred from the compensation tank and into the line system, or vice versa.

According to an embodiment of the invention, the compensation tank can be temporarily separated physically or blocked from the Clausius-Rankine circuit at the line system. When the Clausius-Rankine circuit is operating, the block can be temporarily lifted to supply additional working medium as needed to set a required supercooling of the working medium, particularly in front of the delivery pump.

This is not the case in the prior art, since according to the known solutions the compensation tank either constitutes a part of the line system through which the working medium directly flows or the compensation tank is fluidically connected permanently, i.e. cannot be separated, to the line system to ensure that sufficient working medium is available for the Clausius-Rankine circuit.

According to an embodiment of the invention, however, a fluidic separation is especially advantageous, since in the course of operation, particularly in an internal combustion engine, operating conditions change also in relation to the Clausius-Rankine process, for example if the temperature of the coolant by means of which the condenser is cooled changes due to internal combustion engine operation.

An exemplary embodiment relates to a method for recovering waste heat energy from an internal combustion engine of a motor vehicle in which the waste heat energy is transferred at least partly by means of a heat exchanger device designed as a vaporizer to a working medium conveyed through a line system of a Clausius-Rankine circuit in which the working medium is vaporized by means of a vaporizer, in which the vaporized working medium is expanded at an expansion device, thereby exerting mechanical work, in which the expanded working medium is fluidized with a desired supercooling by means of a condenser, the supercooled working medium being compressed to a higher pressure level at a delivery pump and the desired supercooling of the working medium within the line system being set by a previously blocked fluid connection line between a compensation tank for supplying an additional working medium and the line system being temporarily opened in such a manner that a working medium volume is transferred from the compensation tank into the line system or vice versa.

In this case an active connection between the compensation tank and the line system can thus be created only as needed to facilitate a nearly stepless supercooling of the working medium present within the line system.

The volume of the working medium present in the line system for realizing the Clausius-Rankine circuit can be purposefully metered in such a manner that a desired or required supercooling level is always set particularly downstream from the condenser outlet and upstream from the delivery pump intake.

In this respect, the problem addressed by the invention is solved by, for example, a method for setting a desired supercooling of a working medium in a line system of a Clausius-Rankine circuit in which the desired cooling of the working medium within the line system is set by having a previously closed fluid connection between a compensation tank for supplying an additional volume of working medium and the line system opened in such a manner that a volume of working medium is transferred from the compensation tank into the line system or vice versa.

In this case the specific danger of cavitation at the delivery pump can also be excluded in all operating states of the Clausius-Rankine circuit.

In this respect the problem addressed by the invention can also be solved by, for example, a method for preventing cavitation at a delivery pump operating in a line system of a Clausius-Rankine circuit, according to which method the desired supercooling of the working medium within the line system is set by having a previously separated fluid connection between a compensation tank for supplying an additional volume of working medium and the line system opened in such a manner that a working medium volume is transferred from the compensation tank into the line system or vice versa.

The compensation tank can be physically separated from or connected blocked to the line system through various design measures in such a manner that it can be fluidically connected functionally to the line system only as needed.

An embodiment employing a very simple design provides that the compensation tank and the line system are fluidically connected functionally to one another via a single fluid line, a feed pump being arranged in the single fluid line such that an additional working medium volume can be transferred from the compensation tank into the line system via this feed pump. This embodiment variant constitutes a very simple construction measure that allows the additional working medium volume to be supplied from the compensation tank to the line system until a desired supercooling level is achieved upstream in front of the feed pump intake. In this way additional working medium can be subsequently added to the line system by means of the feed pump in an advantageous manner.

If the feed pump is designed as pressure-resistant, then the single fluid line can be closed by means of the pressure-resistant feed pump when the feed pump is not operating. In this way the compensation tank and the line system can be physically separated from one another through very simple design measures.

Cumulatively or alternatively, it is advantageous if a switchable shut-off valve is arranged in the single fluid line. The switchable shut-off valve prevents the unintended backflow of working medium from the line system into the compensation tank, for example in the event of a feed pump leak.

The shut-off valve can be arranged at the feed pump outlet so that the feed pump can be relieved of a system pressure from the line system side through the closed shut-off valve. In this respect, the shut-off valve is ideally located on the high-pressure side of the feed pump. It would also be possible, however, to arrange it on the low-pressure side as well.

The direction of flow of the feed pump can also be designed to be reversible to allow the working medium to actively be transferred in both directions.

An alternative, second embodiment variant provides that the compensation tank and the line system are fluidically connected functionally to one another via two fluid lines, a feed pump being arranged in one of the two fluid lines such that an additional volume of working medium stored in the compensation tank can be transferred from the compensation tank to the line system, and a switchable shut-off valve being arranged in the other of the two fluid lines such that a working medium present in the line system can be transferred from the line system into the compensation tank.

As in the first embodiment variant, an additional volume of working medium can be actively fed from the compensation tank into the line system via a fluid line in which the feed pump is arranged.

The other of the two fluid lines essentially constitutes a switchable bypass device via which working medium can be routed back into the compensation tank from the line system as needed.

In this respect the line system can be fluidically connected functionally to the compensation tank, with the feed pump being bypassed, by means of the other of the two fluid lines or by means of the switchable bypass device such that a portion of the working medium can be drained from the line system and into the compensation tank simply with the aid of the system pressure prevailing within the line system without a pumping device having to be activated in this process. In this way excess working medium can be drained from the line system by means of a switchable bypass device through simple design measures.

In this regard, the bypass device can be equipped with an appropriate shut-off valve.

In any case the volume of working medium required in the line system can be advantageously regulated by means of the feed pump and the switchable bypass device such that the desired supercooling level of the working medium can always remain set or be adjusted at the condenser outlet at all operating phases.

Furthermore, a non-return valve can be arranged at the feed pump intake or outlet. When the feed pump is not running, the non-return valve positioned in this way can reliably prevent the undesired backflow of a portion of the working medium from the line system into the compensation tank, for example, in the event of a leak at the feed pump, particularly if line system pressure is higher than compensation tank pressure.

Whether or not a non-return valve of this type is required also depends, however, on the type of feed pump used. If the feed pump is a type that is tight when not operating, then a corresponding non-return valve can be omitted.

If, however, a non-return valve is required, then it is preferably arranged between the outlet of the feed pump and a line system connection of the fluid line such that the feed pump can be relieved of system pressure from the line system through the closed non-return valve. In this respect, the non-return valve is ideally located on the high-pressure side of the feed pump.

Another embodiment variant provides that the compensation tank and the line system can be fluidically connected to one another via two fluid lines, a switchable shut-off valve is arranged in each of the two fluid lines in such a manner that an additional volume of working medium stored in the compensation tank can be transferred from the compensation tank into the line system or a working medium present in the line system can be transferred from the line system into the compensation tank.

In this arrangement, an additional feed pump can advantageously be omitted entirely.

In this context, it is advantageous if the delivery pump arranged in the line system is situated between a first line system connection of one of the two fluid lines and a second line system connection of the other of the two fluid lines, the first line system connection being arranged downstream and the second line system connection being arranged upstream from the delivery pump.

To simplify construction of the present invention and thus reduce the costs thereof, the delivery pump by means of which the working medium is conducted within the line system can readily also be used to transfer a portion of the working medium present in the line system into the compensation tank. To accomplish this, the shut-off valve, which is situated in the fluid line downstream from the delivery pump, is opened to allow the working medium to make it to the compensation tank through this fluid line with the aid of the delivery pump.

To furthermore prevent a critical static negative pressure from occurring within the present line system when an internal combustion engine is not running and the Clausius-Rankine circuit is not flowing, the respective shut-off valve can be permanently open. This allows the working medium to always flow from the compensation tank and into the line system, thereby ensuring that the line system can be filled with working medium to the extent that no appreciable negative pressure can arise within the line system. This advantageously allows the risk of outside air entering the line system to be significantly reduced. When the Clausius-Rankine circuit is started up, the working medium, if it expands in volume within the line system as a result of heating, can always escape into the compensation tank via an always open shut-off valve. In this respect, the required fill level of working medium within the line system can be regulated by the feed pump, for example, in concert with a shut-off valve.

It is understood that the present compensation tank can be designed and constructed in a variety of ways.

If the compensation tank comprises a flexible and expandable housing, then the compensation tank can be hermetically sealed and yet filled completely with the working medium, making it possible to forego having a compressible gas in the compensation tank.

If the working medium is not volatile, then the compensation tank can be open to the environment. This constitutes a very simple embodiment variant. In this respect, it is advantageous if the compensation tank has a filling and/or venting port interfacing with the environment.

If the working medium is volatile, then the compensation tank can be equipped with an activated carbon filter interfacing with the environment for the purpose of preventing or at least significantly reducing evaporative loss of the working medium via the filling and/or venting port.

In the two embodiments described above, the ambient pressure would always prevail in the compensation tank.

Alternatively, the compensation tank could also be sealed against the environment via a sealing cap, as is the case with motor vehicle cooling systems. The sealing cap is preferably constructed in such a manner that it can limit both excess pressure as well as a negative pressure in the compensation tank.

Alternatively to this, the compensation tank could be hermetically sealed against the environment. The compensation tank can ideally contain a gaseous medium in addition to the actual working medium. If the gaseous medium is air, then the compensation tank can readily also serve as a collection device for collecting in particular the air entering the line system. This collected air can be purged into the environment by a bleeder valve during operation, for example. Instead of air, an inert gas, such as nitrogen, carbon dioxide, a noble gas or similar, can be used to fill the compensation tank to ensure the long-term stability of working media sensitive to oxygen in the air.

Gas volume can be selected such that a negative pressure can be prevented when the Clausius-Rankine circuit is shut down. In normal operation, the compensation tank is under high pressure and must accordingly be designed as a pressure reservoir.

Depending on the pressure level, it can be expedient and especially advantageous to reverse the direction of flow of the feed pump so that working medium can be conveyed into the compensation tank against the lower line system pressure at the condenser outlet.

Various devices, particularly those connected downstream from the internal combustion engine, can be used as heat source in concert with the vaporizer used as heat exchanger. For example, the waste heat energy of exhaust gasses in the exhaust tailpipe of an exhaust system following exhaust treatment, of recirculated exhaust gasses of an exhaust gas recovery system, of charge air following a compressor, of engine coolant or similar can be used. It is understood that the waste heat energy required for vaporizing the working medium can be derived only from a heat source of this type or from multiple heat sources of this type. In this respect, the present vaporizer serving as heat exchanger can be of various designs. It is additionally advantageous if multiple vaporizers are arranged connected to one another in parallel, in series or in a combination of both methods.

It is understood that various fluids, such as water, ethanol, R245fa, etc. or a mixture thereof, can be used as working medium for a Clausius-Rankine process according to the invention.

At this point it is reemphasized that the compensation tank in this instance is not part of the line system through which the working medium flows. In this regard, the compensation tank is connected to the line system in such a manner that the working medium does not flow through it for the purpose of adjusting supercooling level.

Furthermore, the problem addressed by the invention is also solved by a utility vehicle with an internal combustion engine characterized by a device having one of the features specified here. The inventive device for recovering waste heat energy can be advantageously employed particularly on utility vehicles.

It is especially advantageous if the compensation tank is of variable volume.

It is additionally advantageous if the control device is designed to open or close the valve depending on a prescribed supercooling temperature and/or a detected pump performance in such a manner that a certain volume of working medium is transferred into or from the line system.

It is also advantageous if the volume of working medium can be removed from the line system at the highest point of a pipe bend or a local widening of the line system, so that any harmful gas present in the circuit can be collected at this point and can be transferred into the compensation tank together with the transferred working medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
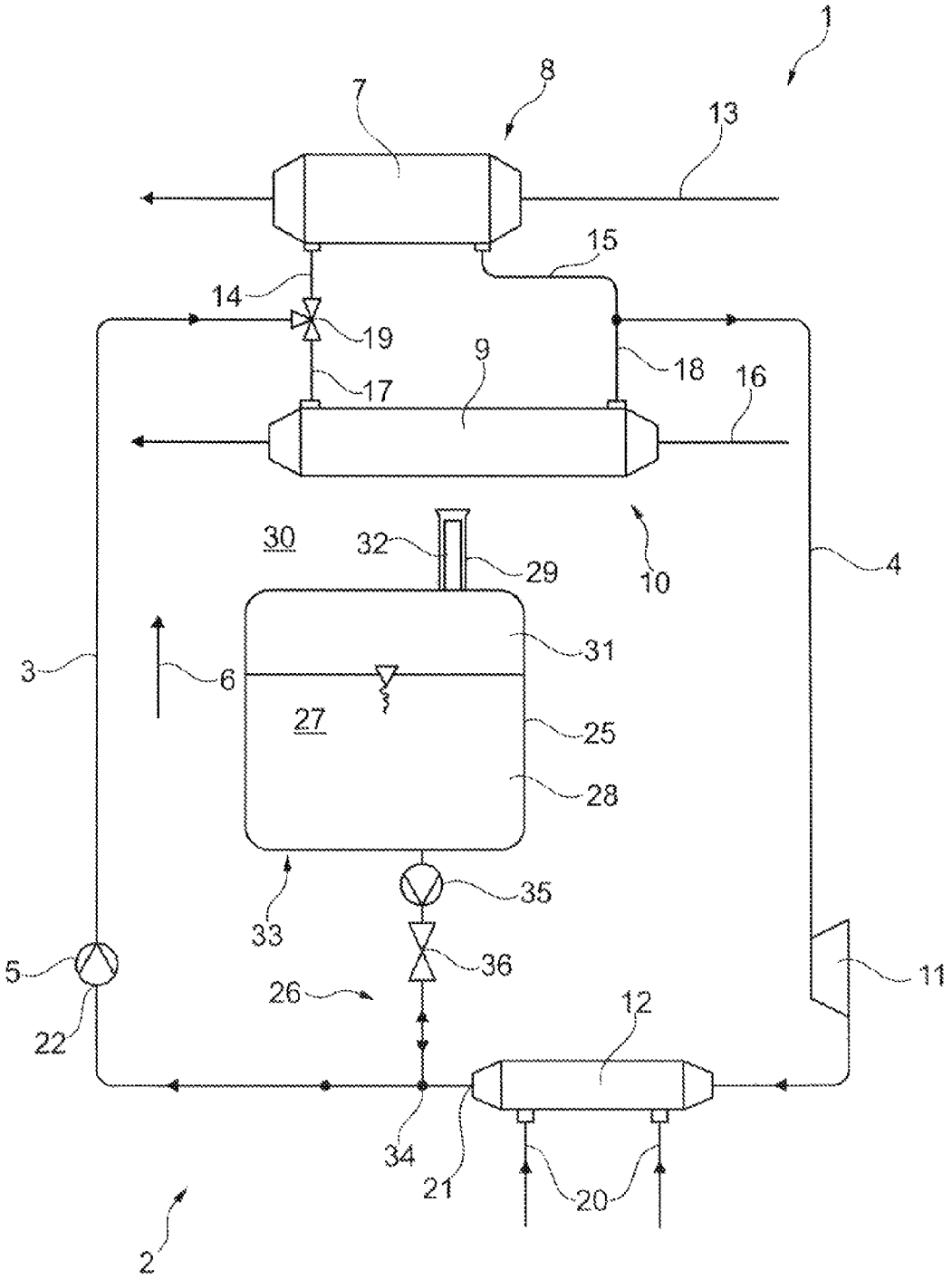
FIG. 1 is a first exemplary embodiment of a waste heat energy recovery device according to the invention having a Clausius-Rankine circuit comprising a line system to which a compensation tank for storing a working medium is isolatably connected.

FIG. 1 shows a first device 1 for recovering waste heat energy of an internal combustion engine not illustrated here of a utility vehicle, likewise not illustrated here. The device 1 comprises a Clausius-Rankine Circuit 2 having a line system 3 in which a working medium 4 is conveyed by a delivery pump 5 in the direction of flow 6. The device 1 furthermore comprises a first heat exchanger 8 designed as vaporizer 7, a second heat exchanger 10 designed as vaporizer 9, an expansion device 11 as well as a condenser 12. The basic process of waste heat recovery is as follows: The delivery pump 5 first compresses the working medium 4 once within a line system 3 to a higher pressure level and then conveys it in toward the vaporizers 7 and 9 in the direction of flow 6. The first heat exchanger 10 realized as vaporizer 9 then transfers waste heat energy from internal combustion engine exhaust gases 13 at least partly to the working medium 4, thereby causing it to vaporize in the vaporizer 7. For this purpose the still liquid working medium 4 flows through an input segment 14 into the vaporizer 7 and then exits the vaporizer 7 through an output segment 15 as vaporized working medium. By means of the second heat exchanger 10 realized as additional vaporizer 9, at least part of the waste heat energy from recirculated exhaust gasses 16 is likewise conducted to the working medium 4, causing it to vaporize in the additional vaporizer 9. In this process, the fluid working medium 4 flows into the vaporizer 7 through an input segment 17 and exits the vaporizer 7 through an output segment 18 as vaporized working medium. Provided between the input segment 14 and the additional input segment 17 is a control valve 19 by means of which the working medium 4 coming from the delivery pump 5 can be distributed, in each instance according to whether only one of the two vaporizers 7 and 9 or both of the vaporizers 7 and 9 are operating. The vaporized working medium 4 is further conveyed to the expansion device 11, where it is then expanded, thereby exerting mechanical output. The mechanical output in this case can be converted into electrical energy in a known manner by means of a generator (not illustrated here). Next, the expanded working medium 4 is further conveyed to the condenser 12, which is cooled by a cooling circuit 20 not further described. The condenser 12 condenses the already expanded working medium, which exists at the condenser outlet 21 with a required supercooling as a reliquified working medium 4. The working medium 4 then makes its way to a delivery pump intake 22 of the delivery pump 5 reliably liquefied and the Clausius-Rankine circuit 2 begins again.

The device 1 is furthermore equipped with a compensation tank 25 which, in this first exemplary embodiment, is connected to the line system 3 via a single fluid line 26, specifically in a manner that the compensation tank 25 is integrated in the line system 3 such that it does not allow passage of working medium 4 therethrough in the direction of flow 6.

The compensation tank 25 features a collection chamber 27 in which an additional working medium volume 28 is stored. Because the collection chamber 27 of the compensation tank 25 interfaces with the environment 30 via a filling and venting port 29, the air present in an upper portion 31 of the collection chamber 27 and thus above the working medium volume 28 is under atmospheric pressure. An activated charcoal filter 32 is placed in the filling and venting port 29 to prevent the working medium 4 from adversely dispersing into the environment.

The compensation tank 25 has a rigid housing 33 and is therefore of rugged construction.

To allow the additional working volume 28 stored in the compensation tank 25 to be transferred into the line system 3 or vice versa, the compensation tank 25 is connected to the line system 3 via fluid line 26 by means of a single connection point 34 downstream directly behind the condenser outlet 20.

An overflowable feed pump 35 and a switchable shut-off valve 36 are arranged in the fluid line 26 such that on one hand the compensation tank 25 and the additional working medium 28 stored therein can be physically separated from the line system 3 and, on the other hand, an additional quantity of working medium 28 can be pumped from the compensation tank 25 into the line system 3 by means of the overflowable feed pump 35. In this respect, the overflowable feed pump 35 can also be used to increase line system pressure. If the overflowable feed pump 35 is not operating, a portion of the working medium 4 can conversely flow out of the line system 3 and back into the compensation tank 25 without any problem if the shut-off valve 36 is open and line system pressure is sufficiently high, since on one hand the collection chamber 27 and the compensation tank 25 are collectively only under atmospheric pressure and, on the other hand, the working medium 4 can flow through the idle and thus overflowable feed pump 35. In this instance, the shut-off valve 36 can thus be used to reduce line system pressure.

Figure 2:
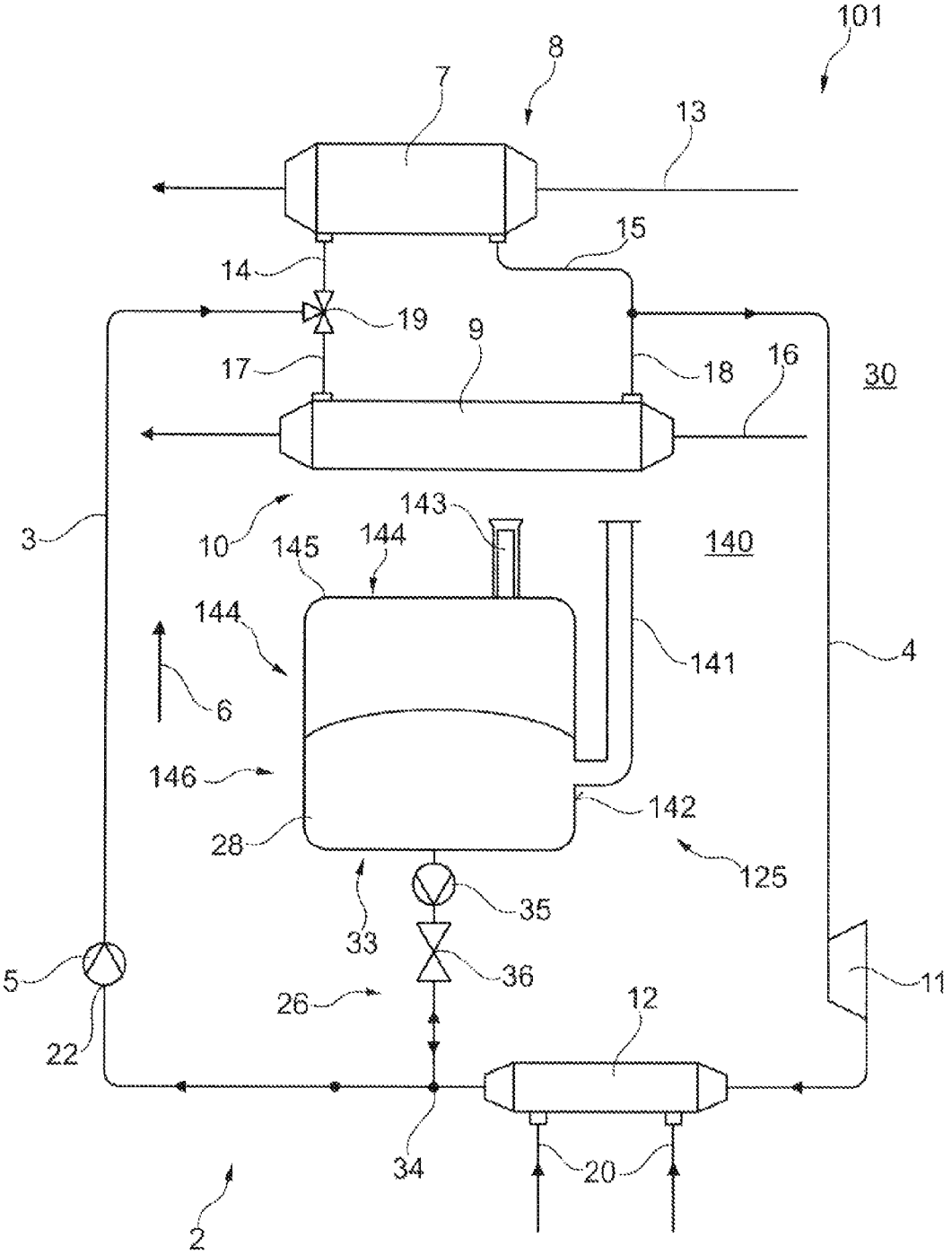
FIG. 2 is another exemplary embodiment of a waste heat energy recovery device according to the invention having a compensation tank of different construction.

The further device 101 illustrated in FIG. 2 is essentially the same as the device 1 shown in FIG. 1. Therefore the same components or components performing the same function are provided with the same reference numbers, and only the distinguishing features of the further device 101 are described.

The further device 101 for recovering waste heat energy is characterized by a differently designed compensation tank 125 which is constructed such that the additional working medium volume 28 stored therein cannot permanently interact with the ambient air 140. For this purpose, the compensation tank 125 features in addition to a working medium filling port 141 arranged laterally on the lower third 142 of the compensation tank 125 a filling gas filling port 143 situated on the lid area 144 of the compensation tank. Both the working medium filling port 141 and the filling gas filling port 143 can each be hermetically sealed by means of a cap not illustrated. This specific design ensures that a filling gas 145 inert to the additional working medium volume 28 always collects in the upper half 144 of the compensation tank 125 and the additional working medium volume 28 accordingly collects in the lower half 146 of the compensation tank 125. The compensation tank 25 likewise features a rigid housing 33 and is accordingly designed to be pressure-resistant.

Figure 3:
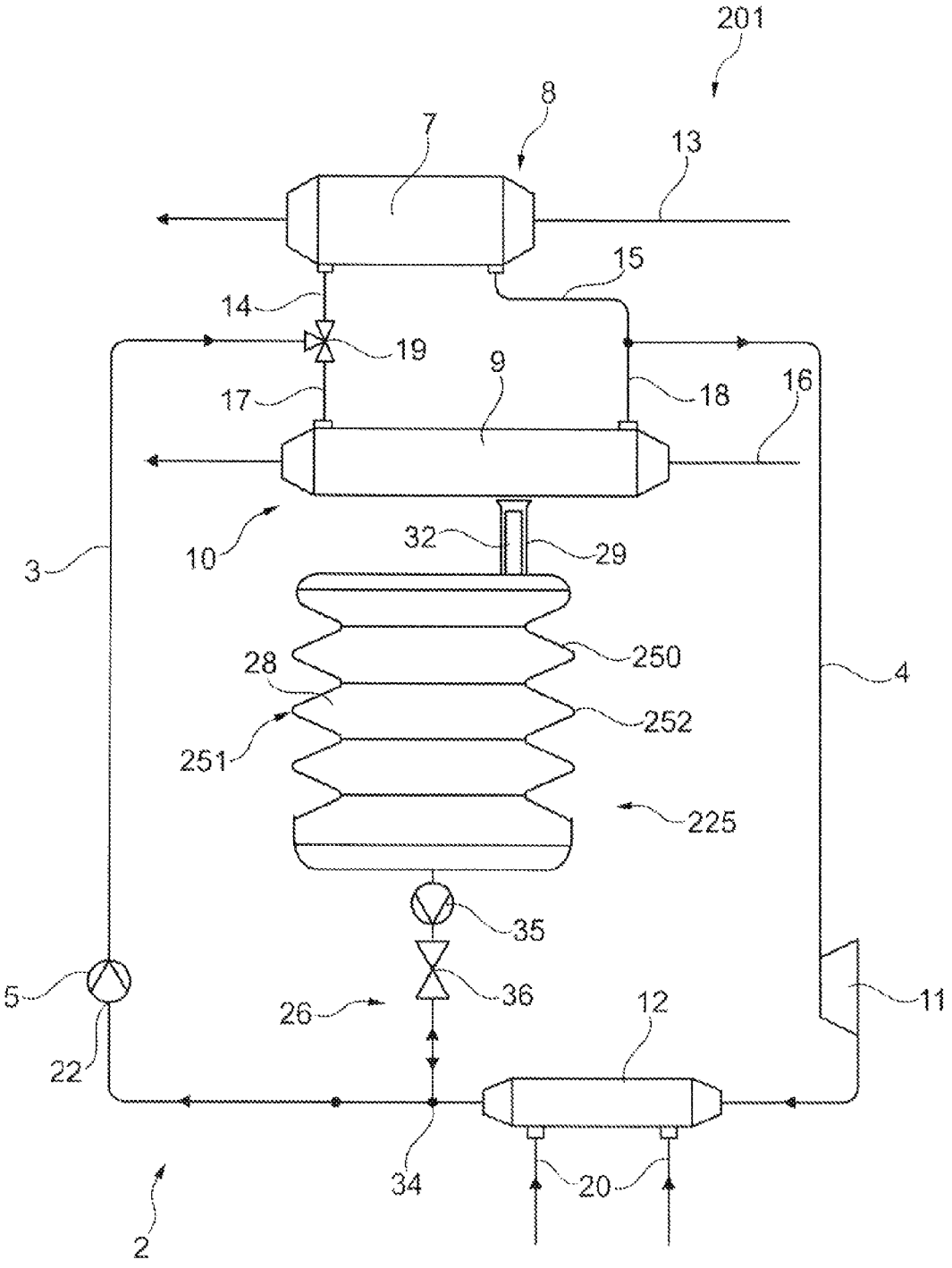
FIG. 3 is another exemplary embodiment of a waste heat energy recovery device according to the invention having a compensation tank of alternative construction.

The alternative device 201 illustrated in FIG. 3 is likewise essentially the same as the devices 1 and 101 illustrated in FIGS. 1 and 2, respectively. Therefore the same components or components performing the same function are provided with the same reference numbers, and only distinguishing features of the further device 201 are accordingly described.

The alternative device 201 for recovering waste heat energy is characterized by another alternatively constructed compensation tank 225. This alternative compensation tank 225 is designed as a bellows unit 250 hermetically sealed against the environment 30, thereby allowing different amounts of working medium volume 28 to be taken up by changing the volume of the alternative compensation tank 225 itself. In other words, the size of the compensation tank 225 adapts to the additional working medium volume 28 being stored. For this purpose, the alternative compensation tank differs from the two previously described compensation tanks 25 and 125 by not having a rigid housing 33, but rather an at least partly flexible housing 251 in the form of a bellows 252. In this embodiment, the compensation tank 225 does not necessarily have to be filled with air (see FIG. 1) or with an inert filling gas (see FIG. 2). Instead of the bellows 252, a membrane container or an elastic bladder element could be provided.

In any case the compensation tanks 25, 125 and 225 shown in FIGS. 1 through 3 are separably or connectably arranged fluidically in relation to the line system 3 in such a manner that an at least local supercooling of the working medium 4 within the line system 3 downstream from the condenser outlet 20 and upstream from the delivery pump intake 37 can be adjusted as a function of the working medium volume 28 transferred from the compensation tank 25 into the line system 3 or vice versa.

Figure 4:
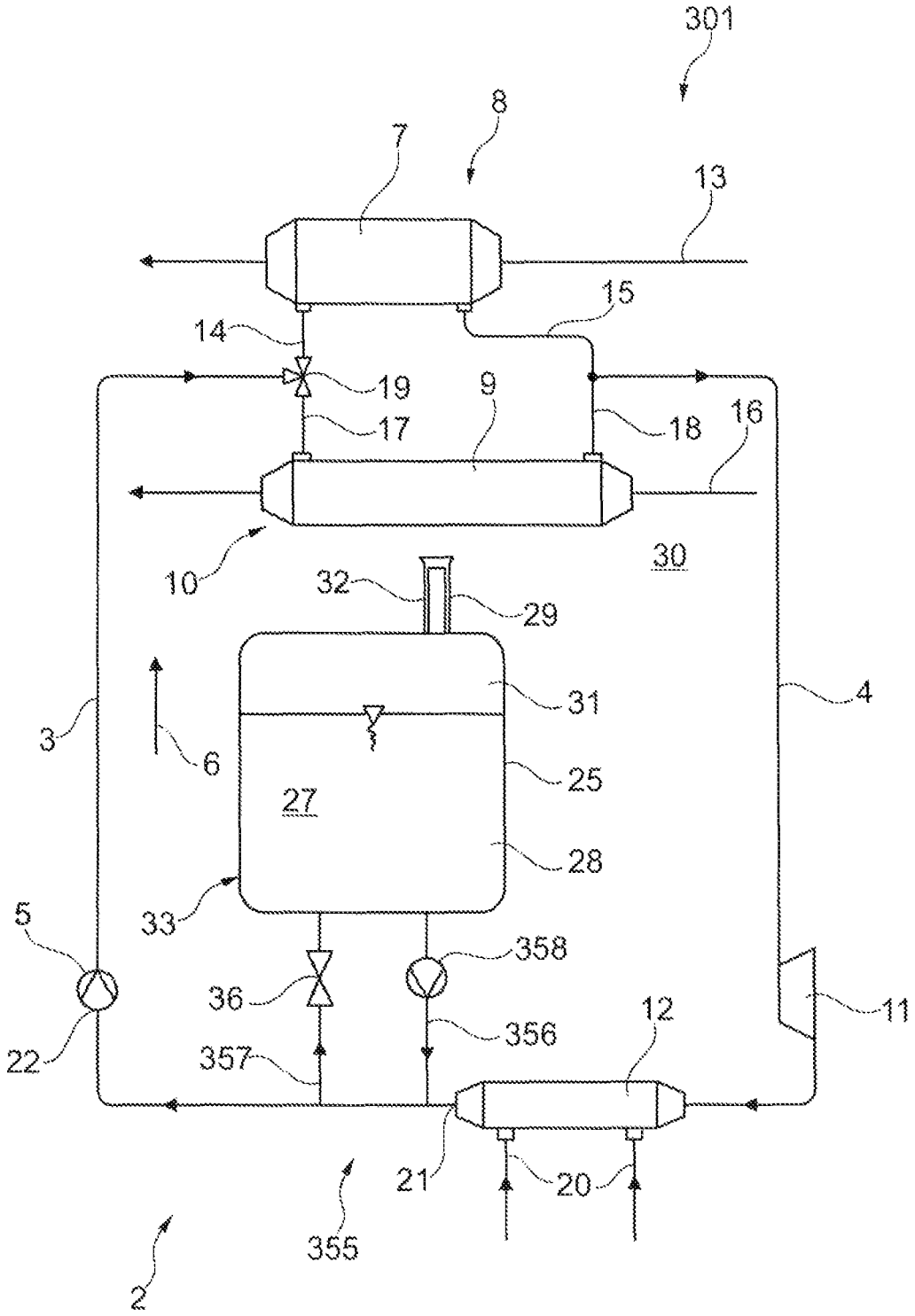
FIG. 4 is another exemplary embodiment of a waste heat energy recovery device according to the invention having an alternative connection arrangement of a compensation tank to a line system of a Clausius-Rankine circuit, FIG. 4A corresponds to the exemplary embodiment of FIG. 4 with the inclusion of a non-return valve at the intake of the feed pump, FIG. 4B corresponds to the exemplary embodiment of FIG. 4 with the inclusion of a non-return valve at the outlet of the feed pump.
Figure 4A:
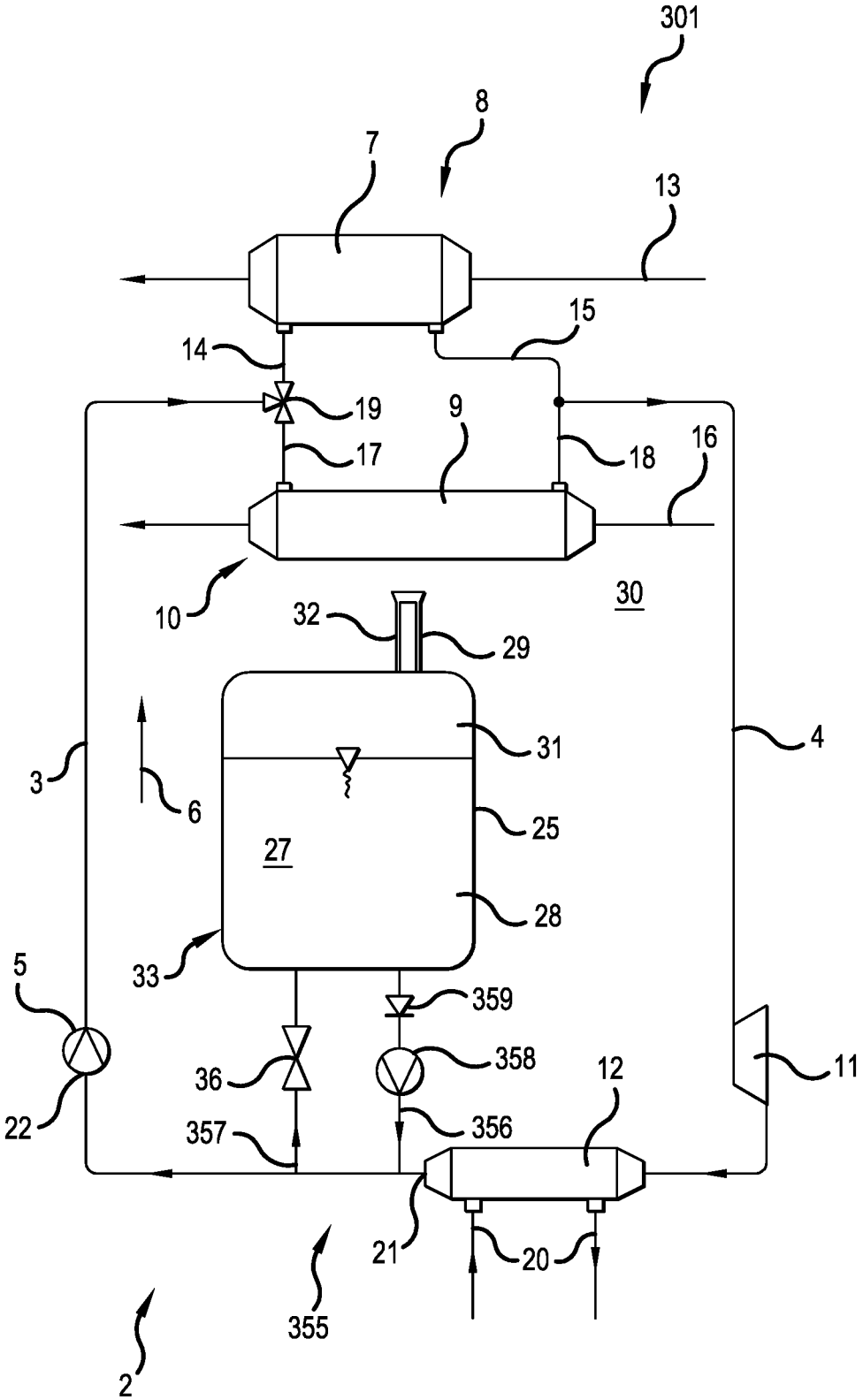
Figure 4B:
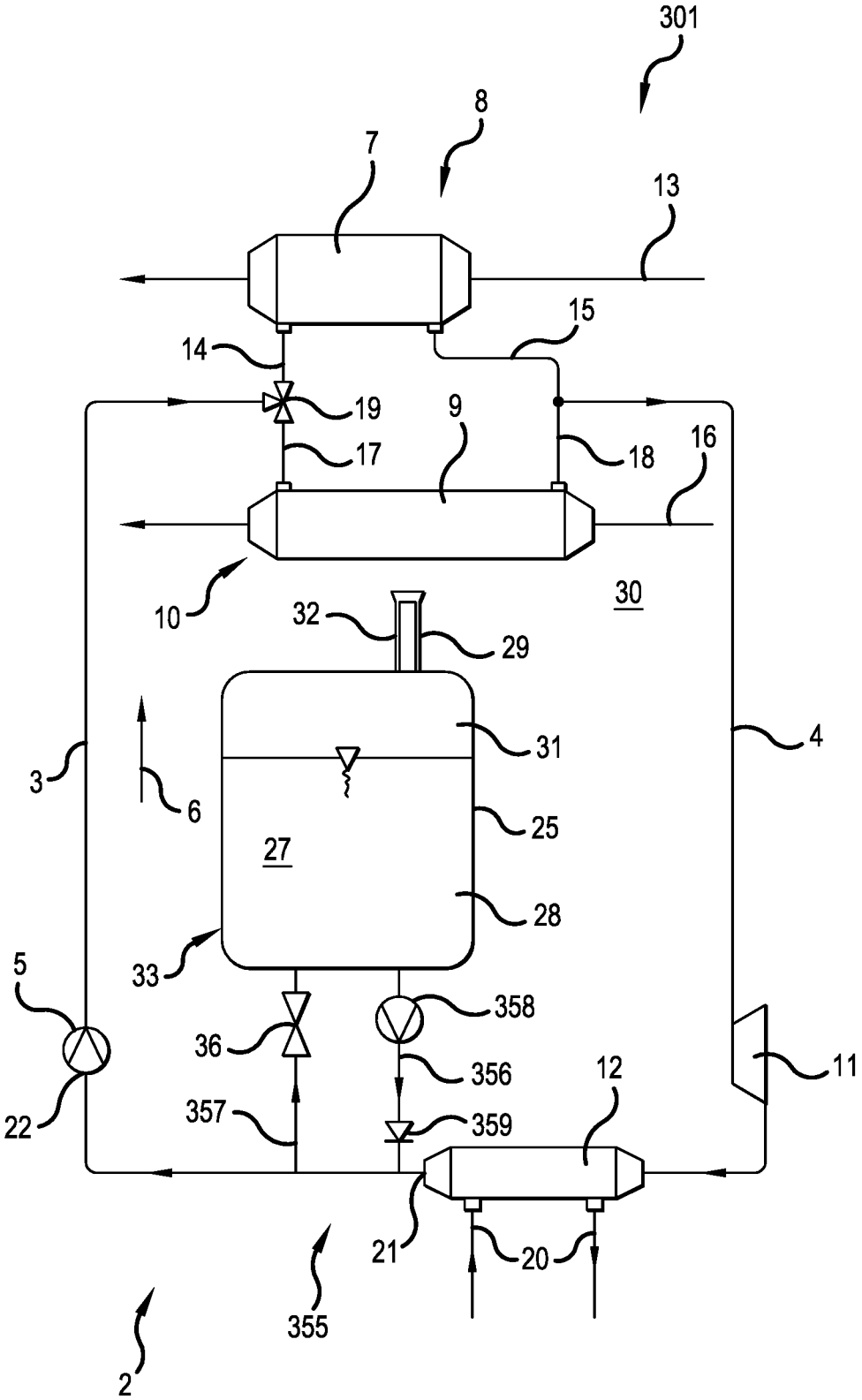

The further device 301 for recovering waste heat illustrated in FIG. 4 is characterized by a different connection arrangement 355, by means of which the compensation tank 25 is connected to the existing line system 3. Otherwise, the device 301 is of identical construction in terms of its Clausius-Rankine circuit 2. Insofar attention in this regard is directed to the explanations regarding the devices 1, 101 and 201, and only the features associated with the connection arrangement 355 deviating from this material are explained below. As FIG. 4 clearly illustrates, the compensation tank 25 in this instance is fluidically connected to the line system 3 via two fluid lines 356 and 357. In this case a pressure-resistant feed pump 358 is arranged in the upstream front fluid line 356 such that the additional working medium volume 28 can be conveyed or transferred from the compensation tank 25 into the line system 3. The pressure-resistant feed pump 358 is characterized in that no working medium 4 can flow through it from the line system 3 and into the storage tank 25 unless the pressure-resistant feed pump 358 is running. Furthermore, a switchable shut-off valve 36 is arranged in the rear fluid line 357 such that the working medium 4 can be transferred from the line system 3 and into the compensation tank 25 if the shut-off valve 36 is accordingly in the open position. Alternatively, the rear fluid line 357 is also tightly closed, thereby physically separating the compensation tank 25 from the line system 3. Also, as shown in FIG. 4A, a non-return valve 359 can be arranged at the intake of the feed pump 358 or, as shown in FIG. 4B, the non-return valve 359 can be arranged at the outlet of the feed pump 358.

Figure 5:
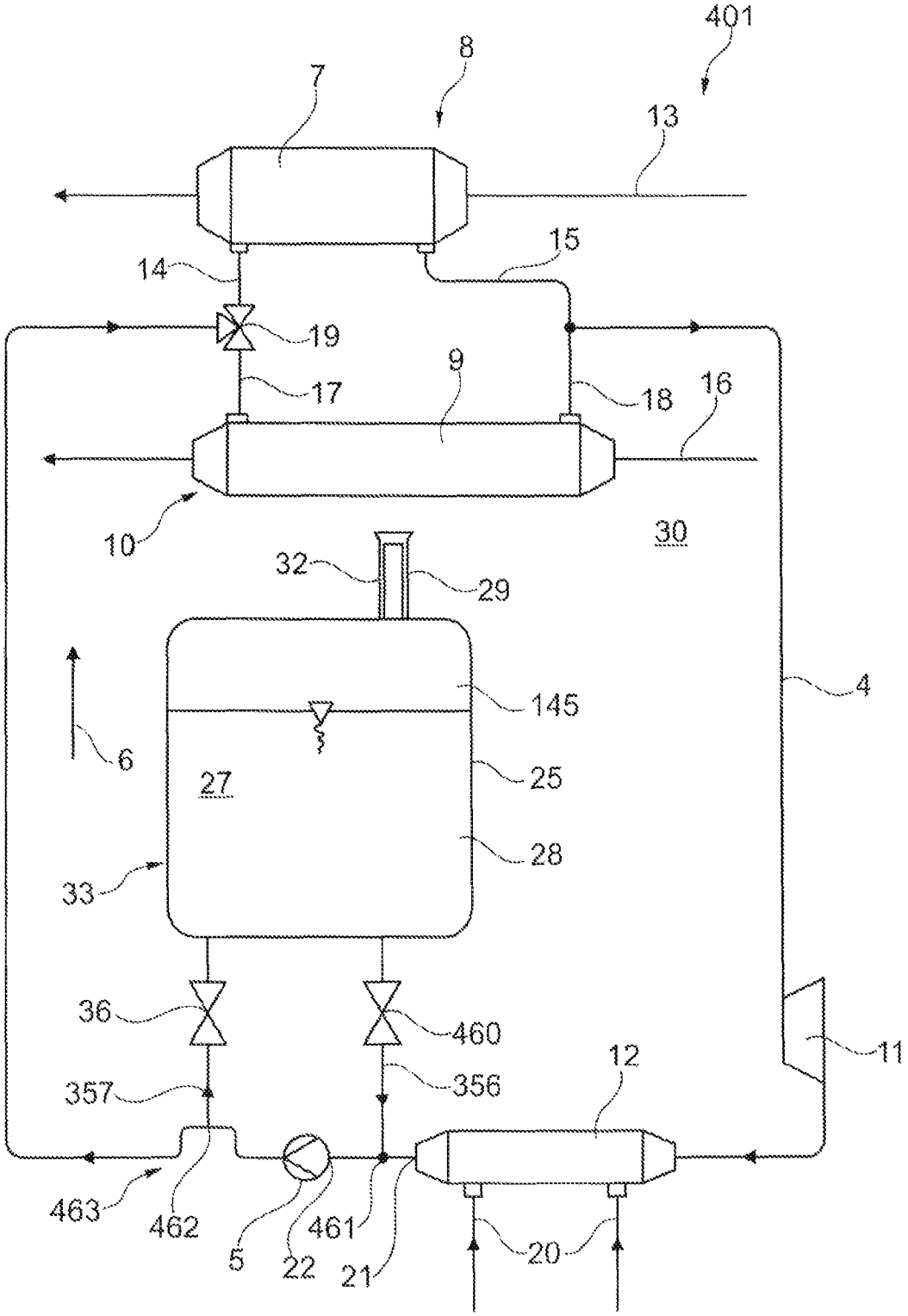
FIG. 5 is another exemplary embodiment of a waste heat energy recovery device according to the invention having another connection arrangement of a compensation tank to a line system of a Clausius-Rankine circuit.

The other device 401 for recovering waste heat energy illustrated in FIG. 5 differs from device 301 (see FIG. 4) only in that an additional shut-off valve 460 is installed in the front fluid line 356 instead of the pressure-resistant feed pump 358 (see FIG. 4) and that the delivery pump 5 is arranged between a front fluid connection 461 of the front fluid line 356 and a rear fluid connection 462 of the rear fluid line 357. In this way, the delivery pump 5 can readily be used for filling the compensation tank 25 via the rear fluid line 357, thereby advantageously allowing component costs to be lowered. In this device 401 the compensation tank 25 is filled once under atmospheric pressure with the Clausius-Rankine circuit 2 still cold until the minimum volume of working medium 4 is present in the compensation tank 25. The compensation tank 25 is then flushed with an inert filling gas 145 and sealed at the filling and venting port 29 with an appropriate closure (not illustrated here). When the Clausius-Rankine circuit 2 is started up, the liquid working medium 4 is first vaporized by means of the transferred waste heat in the vaporizers 7 and/or 9, thereby causing line system pressure to rise, particularly at the condenser outlet 21. If this is not desired, opening the shut-off valve 36 will allow liquid working medium 4 to flow into the compensation tank 25, thereby compressing the filling gas 145 present in the compensation tank 25. This results in a rise in compensation tank pressure. If the Clausius-Rankine circuit 2 is running, the additional shut-off valve 460 can be briefly opened to raise system pressure, and the shut-off valve 36 can be briefly opened to lower line system pressure, thereby allowing the supercooling level to be regulated, particularly in front of delivery pump 5. When the Clausius-Rankine circuit 2 is shut down, the shut-off valves 36 and 460 are preferably open, and the line system 3 can be flooded by working medium 4 from the compensation tank 25. In this case, the pressure level within the line system 3 and the compensation tank 25 decrease back to ambient pressure, thereby allowing a leakage caused by ambient air to be effectively prevented. In addition, the rear fluid connection 462 is situated downstream from the delivery pump 5 in a line elevation 463, thereby allowing any gas entering the line system 3 to be expelled into the compensation tank 25 when the shut-off valve 36 is open by means of a siphoning effect caused by said arrangement and then removed at the next filling procedure.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for recovering waste heat energy of an internal combustion engine in a motor vehicle, the device comprising:

a Clausius-Rankine circuit comprising a line system conveying a working medium, having at least one vaporizer for vaporizing the working medium, an expansion device, a condenser for fluidizing the working medium, and a delivery pump for condensing and conveying the working medium through the line system, the line system, the expansion device, the condenser, and the delivery pump being fluidically connected to one another;

a compensation tank for supplying additional working medium volume and being connected to the line system by a single fluid line, the single fluid line being bidirectional and the single fluid line connecting the compensation tank to the line system at a single connection point located downstream of the condenser and upstream of the delivery pump;

a switchable shut-off valve arranged in the single fluid line, the switchable shut-off valve for fluidically separating the compensation tank from the line system, the switchable shut-off valve being controlled to transfer a working medium volume from the compensation tank into the line system or from the line system into the compensation tank depending on working medium temperature and/or pressure, a feed pump arranged in the single fluid line such that an additional working medium volume is transferred from the compensation tank into the line system via the feed pump, and the feed pump and the switchable shut-off valve being arranged in series in the single fluid line with the switchable shut-off valve positioned between the feed pump and the single connection point and the feed pump positioned between the compensation tank and the switchable shut-off valve.

2. The device as claimed in claim 1, wherein the compensation tank is temporarily connected fluidically to the line system such that within the line system an at least localized supercooling of the working medium is adjusted as a function of a working medium volume transferred from the compensation tank and into the line system or vice versa.

3. The device as claimed in claim 1, wherein an exterior housing of the compensation tank is flexible and expandable, such that the compensation tank has a variable volume.

4. The device as claimed in claim 1, wherein the switchable shut-off valve opens or closes depending on a prescribed supercooling temperature and/or a detected pump performance such that a certain volume of working medium is transferred into or from the line system.

5. A device for recovering waste heat energy of an internal combustion engine in a motor vehicle, the device comprising:

a Clausius-Rankine circuit comprising a line system conveying a working medium, having at least one vaporizer for vaporizing the working medium, an expansion device, a condenser for fluidizing the working medium, and a delivery pump for condensing and conveying the working medium through the line system, the line system, the expansion device, the condenser, and the delivery pump being fluidically connected to one another;

a compensation tank for supplying additional working medium volume and being connected to the line system by two fluid lines that each connect directly to the line system at respective connection points that are located downstream of the condenser;

a switchable shut-off valve for fluidically separating the compensation tank from the line system, the valve being controlled to transfer a working medium volume from the compensation tank into the line system or from the line system into the compensation tank depending on working medium temperature and/or pressure, a feed pump arranged in one of the two fluid lines such that an additional working medium volume stored in the compensation tank is transferred from the compensation tank to the line system, and the switchable shut-off valve being arranged in the other of the two fluid lines such that a working medium present in the line system is transferred from the line system into the compensation tank.

6. The device as claimed in claim 5, further comprising a non-return valve that is arranged at one of an intake or outlet of the feed pump.

7. The device as claimed in claim 5, wherein the one of the two fluid lines is a single direction flow line that flows in a direction from the compensation tank to the line system and the other of the two fluid lines is a single direction flow line that flows in a direction from the line system to the compensation tank.

8. A device for recovering waste heat energy of an internal combustion engine in a motor vehicle, the device comprising:

a Clausius-Rankine circuit comprising a line system conveying a working medium, having at least one vaporizer for vaporizing the working medium, an expansion device, a condenser for fluidizing the working medium, and a delivery pump for condensing and conveying the working medium through the line system, the line system, the expansion device, the condenser, and the delivery pump being fluidically connected to one another;

a compensation tank for supplying additional working medium volume and being connected to the line system by a first fluid line and a second fluid line;

a first switchable shut-off valve and a second switchable shut-off valve for fluidically separating the compensation tank from the line system, the first switchable shut-off valve arranged in the first fluid line and being controlled to transfer the additional working medium volume from the compensation tank into the line system Rolland the second switchable shut-off valve arranged in the second fluid line and being controlled to transfer the working medium from the line system into the compensation tank depending on working medium temperature and/or pressure, and the delivery pump being arranged in the line system between a first line system connection of the first fluid line and a second line system connection of the second fluid line, such that, in a flow direction of the working medium through the line system, the second line system connection is arranged downstream from the delivery pump and the first line system connection is arranged upstream from the delivery pump.

9. The device as claimed in claim 8, wherein the volume of working medium is removed from the line system at the highest point of a line elevation at the first system connection of the line system, so that any harmful gas present in the circuit is collected at the line elevation and is transferred into the compensation tank together with the transferred working medium.

10. A utility vehicle with an internal combustion engine, comprising:

a device for recovering waste heat energy of the internal combustion engine, the device comprising:

a Clausius-Rankine circuit comprising a line system conveying a working medium, having at least one vaporizer for vaporizing the working medium, an expansion device, a condenser for fluidizing the working medium, and a delivery pump for condensing and conveying the working medium through the line system, the line system, the expansion device, the condenser, and the delivery pump being fluidically connected to one another;

a compensation tank for supplying additional working medium volume and being connected to the line system by a single fluid line, the fluid line being bi-directional and the fluid line connecting the compensation tank to the line system at a single connection point located downstream of the condenser and upstream of the delivery pump;

a switchable shut-off valve arranged in the single fluid line, the switchable shut-off valve for fluidically separating the compensation tank from the line system, the switchable shut-off valve being controlled to transfer a working medium volume from the compensation tank into the line system or from the line system into the compensation tank depending on working medium temperature and/or pressure, a feed pump arranged in the single fluid line such that an additional working medium volume is transferred from the compensation tank into the line system via the feed pump, and the feed pump and the switchable shut-off valve being arranged in series in the single fluid line with the switchable shut-off valve positioned between the feed pump and the single connection point and the feed pump positioned between the compensation tank and the switchable shut-off valve.

11. A method for recovering waste heat energy from an internal combustion engine of a motor vehicle, the method comprising:

transferring the waste heat energy, at least partly, to a working medium conveyed in a line system of a Clausius-Rankine circuit;

vaporizing the working medium via a vaporizer, in which the vaporized working medium is expanded at an expansion device thereby exerting mechanical work in which the expanded working medium is fluidized with a desired supercooling via a condenser, the supercooled working medium being compressed to a higher pressure level at a delivery pump; and setting the desired supercooling of the working medium within the line system by a previously blocked fluid connection line between a compensation tank for supplying an additional working medium volume and the line system, the previously blocked fluid connection line being temporarily opened in such a manner that a working medium volume is transferred from the compensation tank into the line system or vice versa, the fluid connection line being a single fluid connection line that connects the compensation tank to the line system at a single connection point located downstream of the condenser and upstream of the delivery pump, the single fluid connection line being bi-directional, a feed pump being arranged in the single fluid connection line such that the additional working medium volume is transferred from the compensation tank into the line system via the feed pump, a switchable shut-off valve being arranged in the single fluid connection line, and the feed pump and the switchable shut-off valve being arranged in series in the single fluid connection line with the switchable shut-off valve positioned between the feed pump and the single connection point and the feed pump positioned between the compensation tank and the switchable shut-off valve.

* * * * *